US008887333B2

(12) United States Patent
Cohen

(10) Patent No.: US 8,887,333 B2
(45) Date of Patent: Nov. 18, 2014

(54) SUPPORT PILLOW

(75) Inventor: Randall P. Cohen, Newtown, PA (US)

(73) Assignee: Sourcing Network International, LLC, Bensalem, PA (US)

( * ) Notice: Subject to any disclaimer, the term of this patent is extended or adjusted under 35 U.S.C. 154(b) by 0 days.

(21) Appl. No.: 13/534,993

(22) Filed: Jun. 27, 2012

(65) Prior Publication Data

US 2014/0000036 A1 Jan. 2, 2014

(51) Int. Cl.
*A47C 20/00* (2006.01)

(52) U.S. Cl.
USPC ..... 5/639; 5/636; 5/637; 5/640

(58) Field of Classification Search
USPC ..... 5/636, 637, 638, 639, 640, 644, 645, 5/655
See application file for complete search history.

(56) References Cited

U.S. PATENT DOCUMENTS

| | | | | |
|---|---|---|---|---|
| 3,426,372 | A * | 2/1969 | Enelow | 5/636 |
| 3,667,074 | A | 6/1972 | Emery | |
| 4,679,263 | A | 7/1987 | Honer | |
| 4,768,245 | A * | 9/1988 | Dutton | 5/636 |
| 5,313,678 | A * | 5/1994 | Redewill | 5/639 |
| 5,344,437 | A | 9/1994 | Pistay | |
| 5,519,906 | A * | 5/1996 | Fanto-Chan | 5/631 |
| 6,009,577 | A * | 1/2000 | Day | 5/636 |
| 6,088,836 | A | 7/2000 | de Cordova | |
| D465,234 | S | 11/2002 | Gordon | |
| 6,532,611 | B1 * | 3/2003 | Day | 5/636 |
| 6,685,024 | B1 | 2/2004 | Matthews | |
| D489,749 | S | 5/2004 | Landvik | |
| 6,820,852 | B2 * | 11/2004 | Wainscott et al. | 248/444.1 |
| 7,428,763 | B2 | 9/2008 | Hightower | |
| D583,605 | S | 12/2008 | Krinsky et al. | |
| 7,657,954 | B1 * | 2/2010 | Bunkers | 5/644 |
| D637,031 | S * | 5/2011 | Anderson | D6/601 |
| 2002/0050007 | A1 | 5/2002 | Kim | |
| 2005/0150050 | A1 | 7/2005 | Wolf et al. | |
| 2005/0155152 | A1 | 7/2005 | Coats et al. | |
| 2005/0210591 | A1 | 9/2005 | Mead et al. | |
| 2005/0278853 | A1 * | 12/2005 | Littlehorn et al. | 5/636 |
| 2007/0271703 | A1 * | 11/2007 | Matthews Brown et al. | 5/636 |
| 2008/0034504 | A1 | 2/2008 | Schmidt | |
| 2008/0216244 | A1 * | 9/2008 | Minton | 5/640 |
| 2009/0013471 | A1 | 1/2009 | Yang | |

(Continued)

FOREIGN PATENT DOCUMENTS

| | | | |
|---|---|---|---|
| DE | 202006005501 | U1 | 8/2006 |
| WO | WO-2011137463 | A2 | 11/2011 |

*Primary Examiner* — William Kelleher
*Assistant Examiner* — Richard G Davis
(74) *Attorney, Agent, or Firm* — Blank Rome LLP

(57) ABSTRACT

A pillow has a body having a medial region and a pair of legs that extend from the medial region to define an opening therebetween. A sleep mask is attached across the front of the pillow by two elastic straps. A storage bag with handles is kept within a storage pocket of the pillow and is attached to the pillow. The bag can be removed from the interior and pulled over the pillow to form a carrying bag. Pouches are retained at the interior of the pillow body and can extend outward from the body. The pouches can fill with fillable material from the interior of the pillow body, allowing the firmness of the pillow to be adjusted. In addition, the legs can then be pushed together so that the pillow can be used as a more traditional pillow rested against a surface.

13 Claims, 10 Drawing Sheets

(56) References Cited

U.S. PATENT DOCUMENTS

| | | | | |
|---|---|---|---|---|
| 2009/0133192 | A1* | 5/2009 | Hassell et al. | 5/639 |
| 2009/0211030 | A1* | 8/2009 | Norstrem | 5/640 |
| 2010/0301655 | A1 | 12/2010 | Mezger | |
| 2011/0179575 | A1 | 7/2011 | Mastrosimone-Gese | |
| 2012/0011655 | A1* | 1/2012 | Rojas | 5/636 |
| 2012/0073055 | A1* | 3/2012 | Cupo | 5/636 |
| 2012/0144590 | A1* | 6/2012 | Sharp | 5/639 |
| 2013/0219624 | A1* | 8/2013 | Soffer et al. | 5/636 |

* cited by examiner

Back

Front 5
10
12
14
15
16
17
18
20
22
23
24
26
28
29
30
40
42
44
45
A
B

Section Views

SUPPORT PILLOW

BACKGROUND OF THE INVENTION

1. Field of the Invention

The present invention relates to a head and neck support pillow. More particularly, the present invention is for a head and neck support pillow that has several features that increase the utility of the support pillow.

2. Background of the Related Art

Support pillows have been developed that can be used for travel or at home. One such pillow is shown in PCT WO2011/137463 to Christie, which includes a sleep mask that attaches to the pillow. U.S. Design Pat. No. D583,605 to Krinsky shows decorative headrest and eyewear. Other support pillows allow users to adjust the amount of padding in the pillow body. For instance, U.S. Pat. No. 3,667,074 to Emery shows a pillow having a zippered opening that allows users to insert of remove padding according to the user's individual requirements. Additional support pillows, such as the pillow described in U.S. Pat. No. 7,428,763 to Hightower, include storage compartments for devices, such as an IPOD® or smartphone. However, a support pillow is needed having features that are easy to use and unobtrusive.

SUMMARY OF THE INVENTION

Accordingly, it is an object of the invention to provide a head and neck support pillow for use during travel or at home. It is another object of the invention to provide a support pillow that is easy to use and is adjustable. It is another object of the invention to provide a support pillow that has an eye mask that is removably attached to the pillow in a convenient manner that is easy to use and fully adjustable, while at the same time unobtrusive. It is a further object of the invention to provide a pillow with adjustable fill. It is yet another object of the invention to provide a support pillow that can be easily stored and carried.

In accordance with these and other objects of the invention, a support pillow is provided that is configured in a U-shape, for cradling and supporting the neck and head of a user. The U-shape includes two leg portions and a medial portion that form a single unitary piece. The two legs join with the medial portion and form the opening between them, which is the space where the neck of a user is received. The opening is configured to receive the neck of a user sufficiently closely to hold the pillow body in position while the user is sitting in repose.

The leg portions have distal end portions that come together. Fastener openings, such as zippers or VELCRO™, are provided along the curved outer periphery of the body at the distal end portions. A fastener on each of the distal ends can be removably locked together. The fasteners can be located on flat tab projections that extend out from the extreme ends of the distal end portions. In one embodiment of the invention, the fasteners are snaps or buttons that align with one another and can be removably coupled together. In an unlocked position, the fasteners are not coupled to each other, so that the user can place the pillow in position with the opening located about the user's neck. And, the user can more easily remove the pillow after use. In a locked position, the fasteners are coupled to one another, thereby securing the distal ends of the support pillow together. The fasteners are locked together after the pillow is placed about the user's neck, to keep the pillow in position while the user is in repose. It is noted that any suitable fasteners can be utilized, such as VELCRO™, and that a fastener need not be provided on each leg but only on one leg. Preferably, however, the fastener is easy to remove and would come free fairly easily, to avoid any injury to the user. The fasteners may also be used to attach the support pillow to a suitcase during travel so the pillow does not fall on the ground.

The pillow includes a sleep mask that is coupled to the pillow body. The sleep mask is positioned to be worn over the eyes of the user when the pillow body is placed about the neck of the user, to facilitate sleep by blocking light. The sleep mask is elongated and can extend from one side of the body to the other opposite side. Elongated elastic support members are provided on the opposite ends of the sleep mask. The elastic supports each have a mask end that connects to the mask, and a fastener end opposite the mask end. The fastener end has mask fastener that allows the sleep mask to be attached to the legs of the support pillow. The fasteners may also be hidden away inside the pillow when not in use. The sleep mask may also be permanently attached to the pillow on one end with a fastener on the opposite end. The sleep mask with fastener can then be hidden inside the pillow when not in use.

The mask fasteners connect with projection tabs positioned along the curved outer surface of the support pillow. The mask fasteners may either permanently secure the sleep mask to the support pillow, or releasably secure the sleep mask (e.g., with snap fasteners or VELCRO™). The fasteners allow the user to don and remove the sleep mask without misplacing or dropping the sleep mask. The elastic support members apply an inward bias that firmly retains the mask against the user. The elastic support members also allow the sleep mask to pivot and rotate with respect to the body, so that the sleep mask can be comfortably positioned on the user's face independent of the position of the body.

A storage pocket is provided at the front of one leg. The storage pocket can be used to contain any device of user's choice (e.g., a portable music player or mobile phone). It can also contain the sleep mask when not in use, or a separate storage pocket can be provided elsewhere on the body to store the sleep mask. The storage pocket may include suitable closure means, such as a zipper or VELCRO™, if desired. Another pocket is provided along the curved outer periphery of the medial region, and removably closed by a fastener. This pocket is used to contain a storage bag. The storage bag may include handles for carrying the storage bag. The storage bag is attached to the pillow body along the curved outer periphery of the medial region and may be wrapped around the support pillow for ease of carrying.

The thickness of the support pillow may be adjusted by inserting or removing displacing filling material from the interior to an expandable external pouch, which may be expanded by opening a fastener closing. In one embodiment of the invention, the removable filling materials comprise a storage pouch containing microbeads or other filling material that can be displaced from the interior. This storage pouch may be permanently attached to the pillow body. The filling is permanently inside of the pillow and the filling is shifted into the pouches to accomplish the firmness adjustability. Also that by adjusting the filling, the back of the pillow can become flat to make a more comfortable pillow that can be placed on the surface of an object, such as an angled top airplane seat or bus seat. Because an airplane or bus seat is sometimes angled permanently forward at the top, adjusting the filling of the support pillow will allow the head of a person to maintain a comfortable position (and not be forced further forward to a very uncomfortable position by a thick back of the support pillow), while comfortable support is still provided by the filled sides of the support pillow.

Another embodiment of the support pillow includes an inflatable interior pouch that may be inflated or deflated to the user's taste. Deflating the pillow also makes the pillow more compact for transport. The support pillow also includes permanent filling material that cannot be removed by the user. This allows for the creation of a hybrid pillow that has the flexibility of an inflatable pillow and the comfort of a microbead or stuffed pillow. The support pillow may include a strap that can hold the legs of the support pillow together (after adjusting the filling of the pillow), thereby allowing the user to place his head against the pillow. VELCRO™ can also be used to hold the legs of the support pillow together. The support pillow may include support pockets that can hold a mobile computing device (e.g., an IPAD™) in place for viewing by the user.

These and other objects of the invention, as well as many of the intended advantages thereof, will become more readily apparent when reference is made to the following description, taken in conjunction with the accompanying drawings.

BRIEF DESCRIPTION OF THE FIGURES

FIG. 3(*b*) shows the sleep mask removed from the body of the pillow;

FIG. 5(*b*) shows the pillow folded into the storage bag in a storage position;

FIG. 6(*b*) shows a cross-section of the pillow taken along lines B-B of FIG. 1, and illustrating an interior view of a longitudinal portion of the support pillow of FIG. 1;

FIG. 7(*b*) is a side cross-section view of the pillow of FIG. 7(*a*);

FIG. 7(*c*) is a perspective of the pillow folded to fit into a suitcase;

FIG. 7(*d*) is a perspective view of the deflated pillow with the legs together and folded onto itself;

FIG. 8(*b*) shows the pillow of FIG. 8(*a*) in use;

FIG. 8(*c*) shows the pillow of FIG. 8(*a*) with the strap in an unlocked position;

FIG. 8(*d*) shows the pillow of FIG. 8(*a*) with the storage bag operating as a pillow cover;

DETAILED DESCRIPTION OF THE PREFERRED EMBODIMENTS

Figures 1, 2, 6A, 6B:
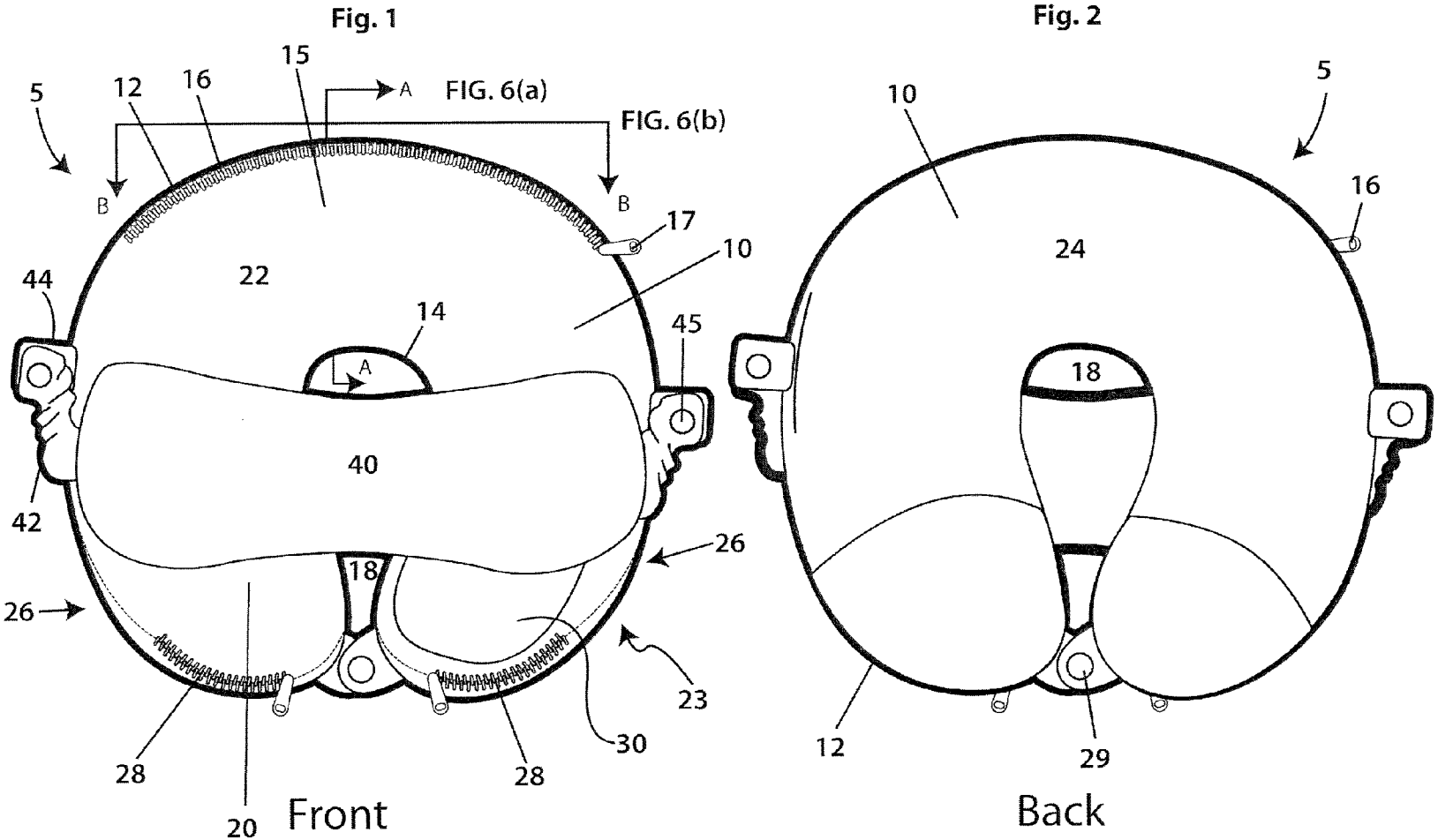
FIG. 1 shows the top view of the support pillow in accordance with an exemplary embodiment of the invention.
FIG. 2 shows the bottom view of the support pillow of FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

As shown in FIGS. 1-2, a support pillow 5 is provided. The pillow 5 is configured in a U-shape, for cradling the neck and head of a user. The support pillow comprises a pillow body 10 having two leg portions 20 and a medial portion 15 that form a single unitary piece. For convenience of discussion, the body 10 of the support pillow 5 may be considered as having a front 22 (FIG. 1), a rear 24 (FIG. 2), and a side portion 23 (best shown in FIG. 4) between the front 22 and the rear 24, as well as a top, bottom and two opposing sides. The body 10 defines a curved outer periphery 12 (at an outer part of the side portion 23) that is rounded in both a longitudinal and a lateral direction. The body 10 further includes a curved central inner periphery 14 (at an inner part of the side portion 23) that defines a rounded, generally circular or elliptical opening 18. The two legs 20 join with the medial region 15 and form the opening 18 between them and where they join the medial region 15. Thus, the opening 18 is defined by the space between the legs 20 and the medial region 15 of the pillow body 10. The opening 18 is the space where the neck of a user is received. The opening 18 is configured to receive the neck of a user sufficiently closely to hold the pillow body 10 in position while the user is sitting in repose.

The leg portions 20 have distal end portions 26 that come together. A fastener attachment 29 is provided along the curved outer periphery 12 at the distal ends 26 of each of the legs 20. The fasteners 29 can be removably locked together. As shown, the fasteners 29 can each be located on flat tab projection that extends out from the extreme end of the respective distal end portion 26. The tabs are substantially planar with each other and the front surface of the body 10, and are made of cloth or other flexible material to be able to come together easily. In the embodiment shown, the fasteners 29 are snaps or buttons that align with one another and can be removably coupled together.

In an unlocked position, the fasteners 29 are not coupled to each other. In this position, the user can place the pillow 5 in position with the opening 18 located about the user's neck. And, the user can more easily remove the pillow 5 after use. In a locked position, the fasteners 29 are coupled to one another, thereby securing the distal ends 26 of the support pillow 5 together. The fasteners 29 are locked together after the pillow 5 is placed about the user's neck, to keep the pillow 5 in position while the user is sleeping. It is noted that any suitable fasteners 29 can be utilized, such as VELCRO™, and that a fastener 29 need not be provided on each leg 20 but only on one leg 20. Preferably, however, the fastener 29 should be sufficiently strong to stay coupled due to normal pressure while the user is sleeping; but should also be easy to remove and come free in response to any undue pressure to avoid any injury to the user.

As best shown in FIG. 1, the pillow 5 includes a sleep mask 40 that is coupled to the pillow body 10. The sleep mask 40 is positioned to be worn over the eyes of the user when the pillow body 10 is placed about the neck of the user, to facilitate sleep by blocking light. As shown, the sleep mask 40 is elongated and can extend from one side of the body 10 to the other opposite side. Elongated elastic straps or support members 42 are provided on the opposite ends of the sleep mask 40. The elastic supports 42 each have a mask end that connects to the mask 40, and a fastener end opposite the mask end. The fastener end has mask fastener 45 that allow the sleep mask 40 to be attached to the legs 20 of the support pillow 5. One or both ends of the mask can be permanently attached to the inside of the pillow and the whole mechanism would store inside of the side of the pillow.

The mask fasteners 45 connect with projection tabs 44 positioned along the curved outer surface 12 at the side portion 23 of the support pillow 5. The mask fasteners 45 may either permanently secure the sleep mask 40 to the support pillow 5, or releasably secure the sleep mask 40 (e.g., with snap fasteners or VELCRO™). The fasteners 45 allow the user to don and remove the sleep mask 40 without misplacing or dropping the sleep mask 40. The elastic support members 42 apply an inward bias that firmly retains the mask 40 against the user's face. The elastic support members 42 also allow the sleep mask 40 to pivot and rotate with respect to the body 10, so that the sleep mask 40 can be comfortably positioned on the user's face independent of the position of the pillow body 10. In the ready position shown in FIG. 1, however, the sleep mask 40 lies across the front surface 22 of the body 10 and is in a plane that is substantially coplanar with the front surface 22 of the body 10. The mask 40 extends from the left to the right (side to side) in the embodiment shown. In that position, the mask 40 is easy for the user to grab and position on the face; but at the same time is unobtrusive when the pillow 5 is being carried, stored, or used for other purposes.

Figures 3A, 3B:
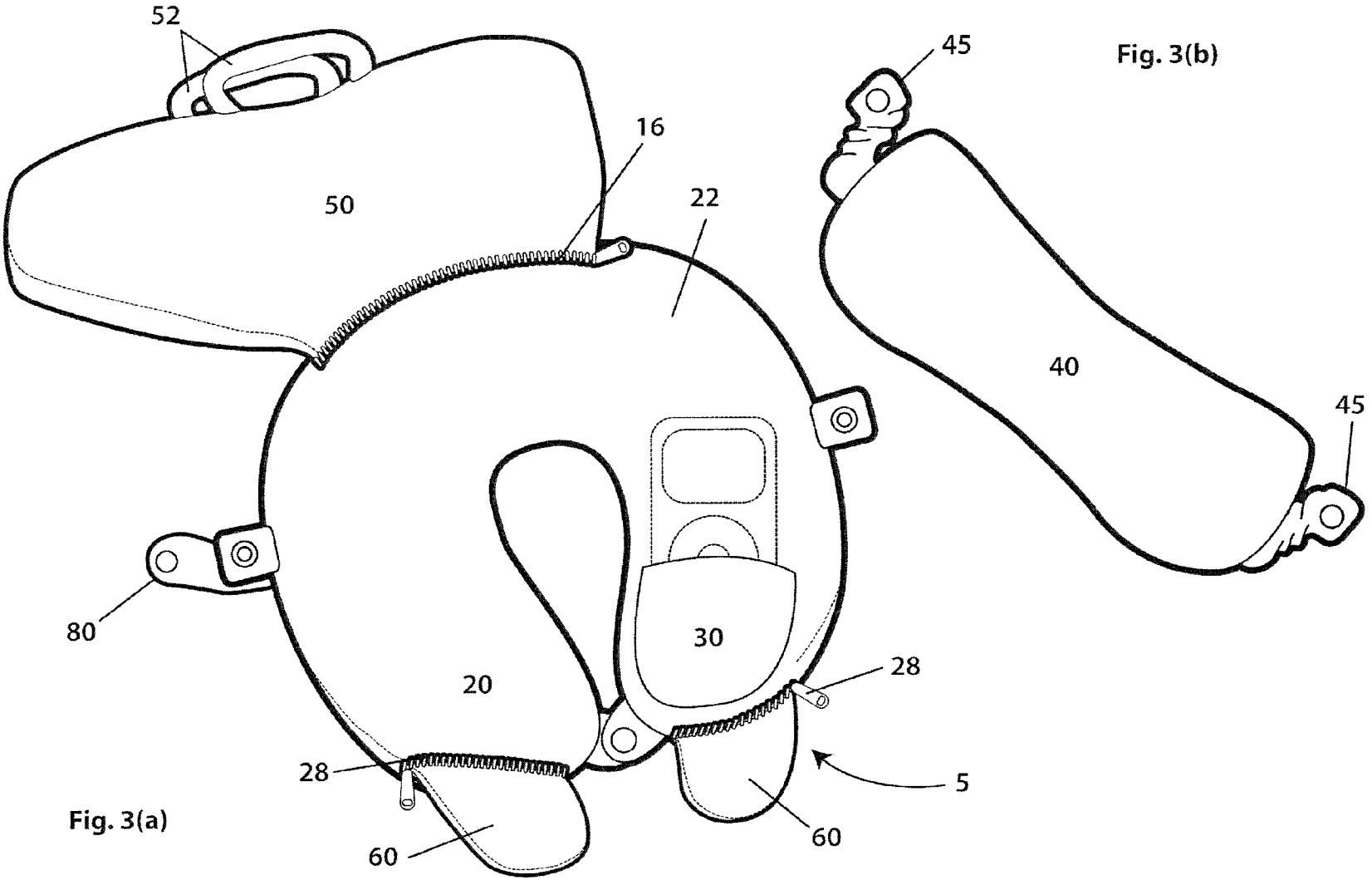
FIG. 3(*a*) is a perspective view of FIG. 1 with the storage bag and filling material exposed.

Referring to FIG. 3, a storage pocket 30 is provided at the front 22 of one of the legs 20. The storage pocket 30 can be used to hold any device of the user's choice (e.g., a portable music player or mobile phone). It can also hold the sleep mask 40 when not in use (and removed from the body 10 of the pillow 5), or a separate storage pocket can be provided elsewhere on the body 10 (side portion 23, front 22 or rear 24) to store the sleep mask 40. The storage pocket 30 may include a suitable closure device, such as a zipper or VELCRO™, if desired. Of course, any suitable number of pockets 30 can be provided on the front 22, rear 24 or side portion 23 of the pillow 5.

A larger opening or pocket 16 is provided along the curved outer periphery 12 of the medial region 15, and removably closed by a fastener 17. This pocket 16 is used to hold a storage bag 50. The storage bag 50 can include handles 52 for carrying the storage bag 50, or a string that can be tied closed (see FIG. 8(*d*)). The storage bag 50 is attached to the pillow body 10 along the curved outer periphery 12 of the medial region 15. Thus, the storage bag 50 is integral with the body 10 of the pillow 5. The storage bag 50 is folded up within the pocket 16 when it is closed and the bag 50 is not being used. When the pocket 16 is opened, the storage bag 50 can be retrieved and pulled out (as shown in FIG. 3(*a*)) by the user, but the storage bag 50 will not come free of the pillow body 10 so that it does not get lost and is readily accessible to the user. The storage bag 50 can also act as a pillow case when the pillow ends are together with strap and the pillow is being used as a traditional pillow, as shown in FIG. 8(*d*).

Pouches 60 are provided that enable the user to adjust the thickness and/or firmness of the support pillow 5. Fasteners 28 (e.g., zippers or VELCRO™) are provided along the curved outer periphery 12 at the side portion 23 of the body 10 at the distal end portions 26 of the legs 20. The fasteners 28 provide access to pouches 60 located inside the body 10 of the pillow 5. When the fasteners 28 are closed, the pouches 60 are inside the body 10. When the fasteners 28 are opened, the pouches 60 can be pulled out from the body 10 for use. The pouches 60 are connected to the body 10 so that they do not come free of the body 10.

Figure 4:
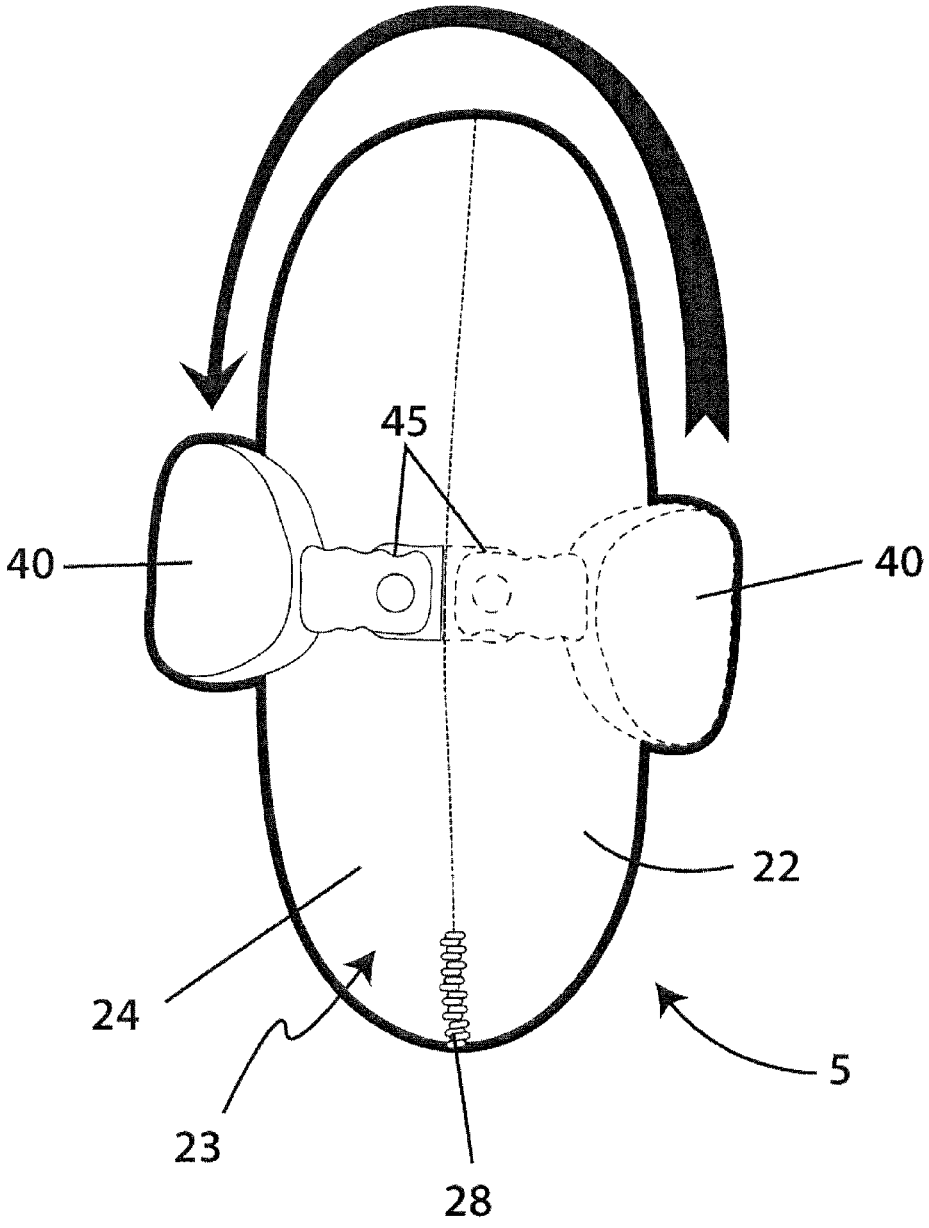
FIG. 4 shows the left side view of the support pillow of FIG. 1, with the sleep mask moving from the front of the pillow to the rear.

Referring to FIG. 4, the sleep mask 40 can be moved by the user from the front 22 to the rear 24 when the sleep mask 40 is not in use, or depending on whether the mask 40 is to be used at the front 22 or the rear 24. As illustrated by the arrow, the user has moved the mask 40 from the front 22 to the rear 24 by sliding the mask 40 over one side (the top in the embodiment shown) of the pillow 5. For instance, the mask 40 can be positioned at the rear 24 of the pillow 5 (or toward the top of the pillow), the pillow 5 can then be placed around the user's neck, and then the mask 40 can be slid over the top of the pillow 5 and placed over the user's face for use.

During this process, the user can flip the sleep mask 40 (which can be reversible) over, so that the tabs 44 are not twisted. In an alternative embodiment, the elastic members 42 can be directly attached to the pillow body 10, such as being sewn. Or, the fasteners 45 can be of the type that do not become twisted, such as the fastener 45 can be a button that attaches to a button that is directly on the pillow body 10 (without the use of a tab 44). Or, a button fastener 55 can be provided on each side of the tab 44, so that the mask 40 can be removably attached to either the front 22 or rear 24 of the pillow 5.

Figure 5B:
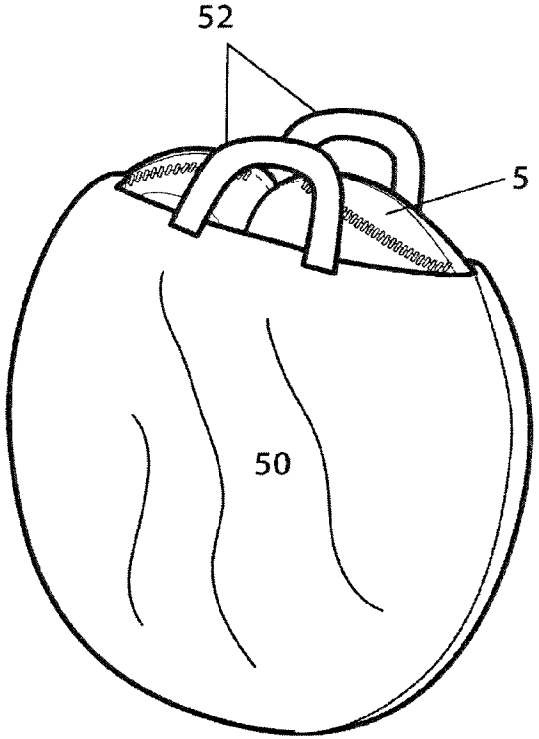
FIG. 5(*a*) is a perspective view of the pillow being prepared for storage.
Figure 5A:
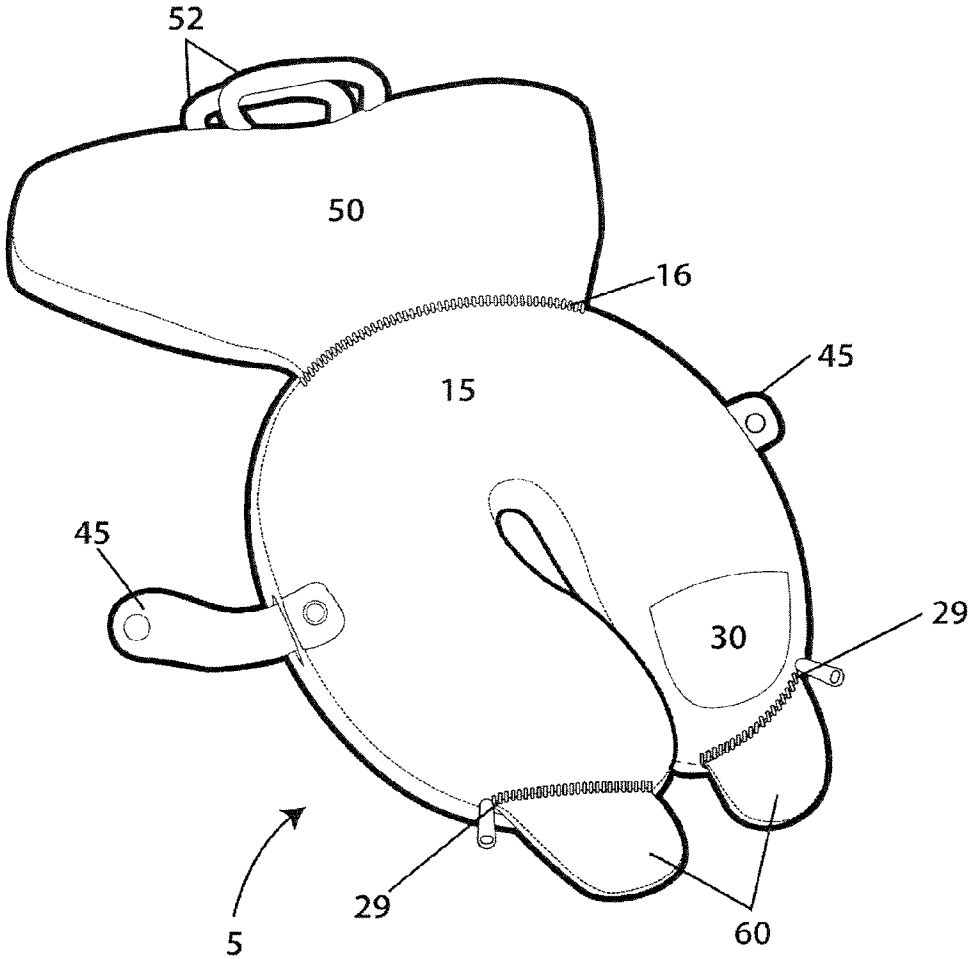

Referring to FIGS. 5(*a*) and 5(*b*), the operation of the storage bag 50 is depicted. In FIG. 5(*a*), the storage bag 50 is shown removed from the pocket 16 and ready for use. The storage bag 50 is wrapped around the support pillow 5 by turning the bag inside-out and pulling it across the pillow body 10 until the entire pillow body 10 is encased inside of the storage bag 50, as shown in FIG. 5(*b*). In this storage position, the storage bag 50 envelops the entire support pillow 5, allowing the user to carry the support pillow 5 by the storage bag handles 52. The top of the storage bag 50 can also be provided with a zipper or other closure, to more fully protect the pillow 5 and prevent any contents from escaping (such as the mask 40 or a device stored in the pocket 30). The bag 50 has the same shape as the pillow body 10, but is slightly larger than the pillow body 10.

In the storage position of FIG. 5(*b*), the pillow 5 is protected against wear and tear, from becoming dirty, and from the sleep mask 40 or tabs 45 catching on other items. The bag 50 remains attached to the pillow body 10 just inside the storage pocket 16. Once the pillow 5 is ready to be used, the user simply slips the bag 50 down from around the body 10, returns the bag 50 to its storage pocket 16, and closes the pocket 16 with the zipper 17.

Figures 6A, 6B:
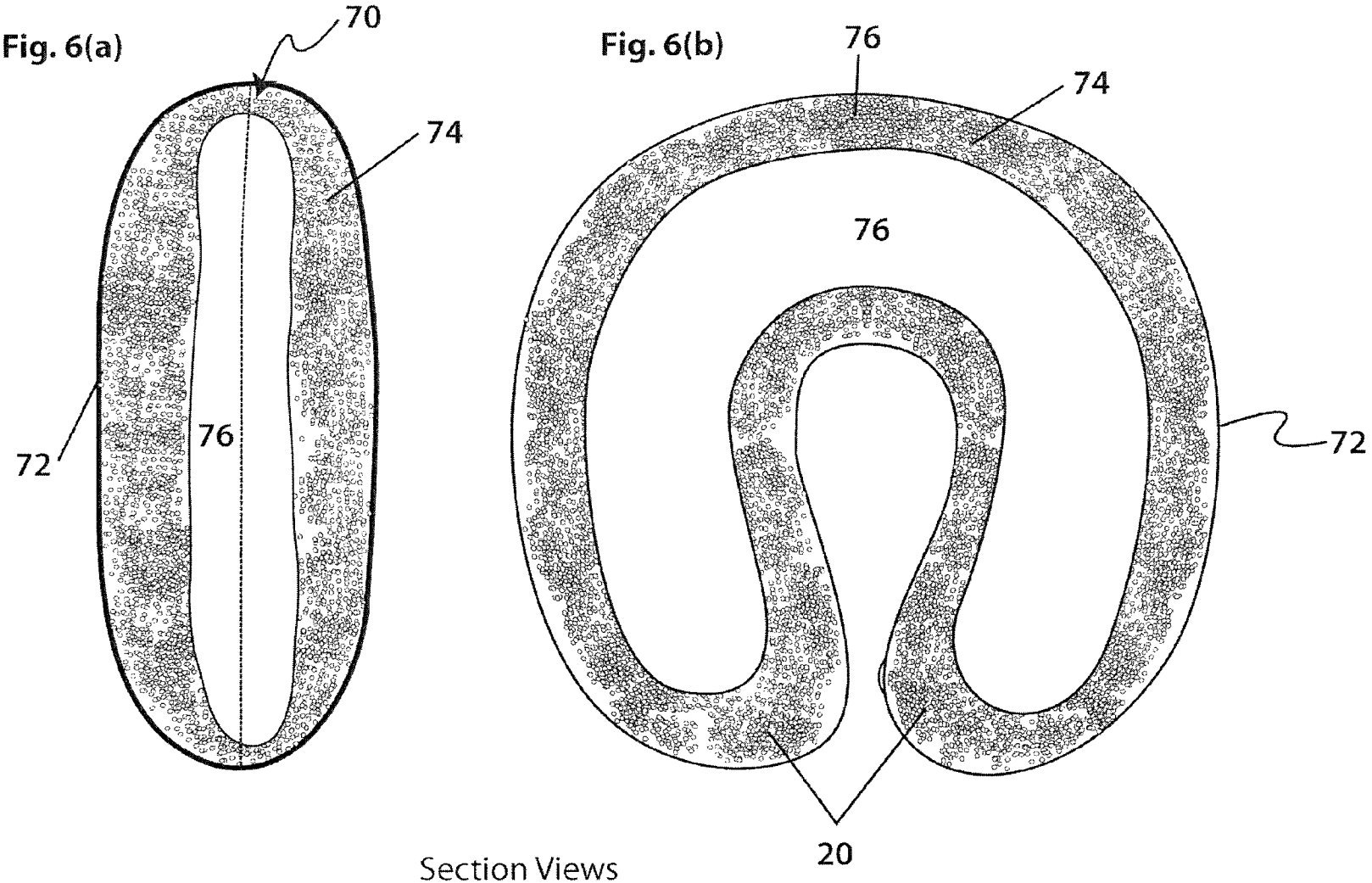
FIG. 6(*a*) shows a cross-section of the pillow taken along lines A-A of FIG. 1, and illustrating an interior view of a transverse portion of the support pillow of FIG. 1.
Figure 7A:
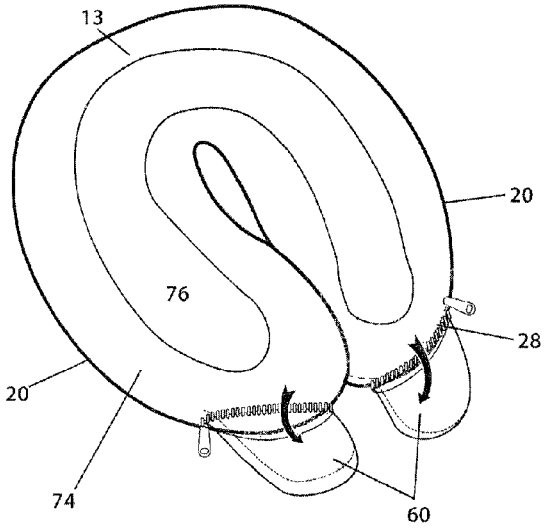
FIG. 7(*a*) is a perspective cross-section of the pillow body showing the interior compartment, and a top view of the outside surface of the distal end portions of the leg portions of the pillow with the filling material exposed.
Figure 7B:
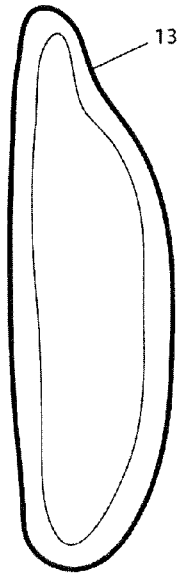
Figure 7C:
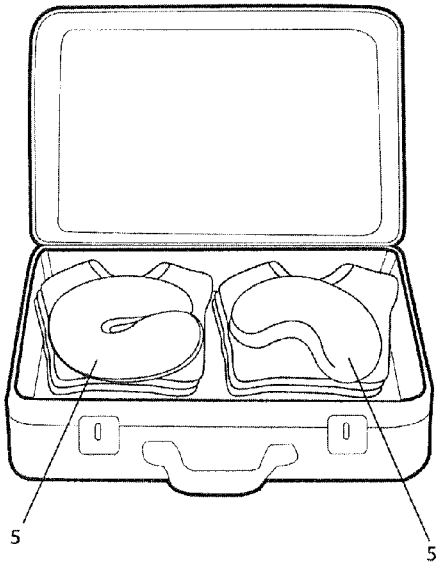
Figure 7D:
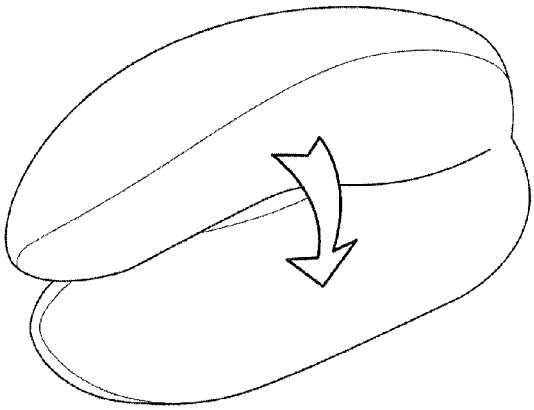
Figure 8C:
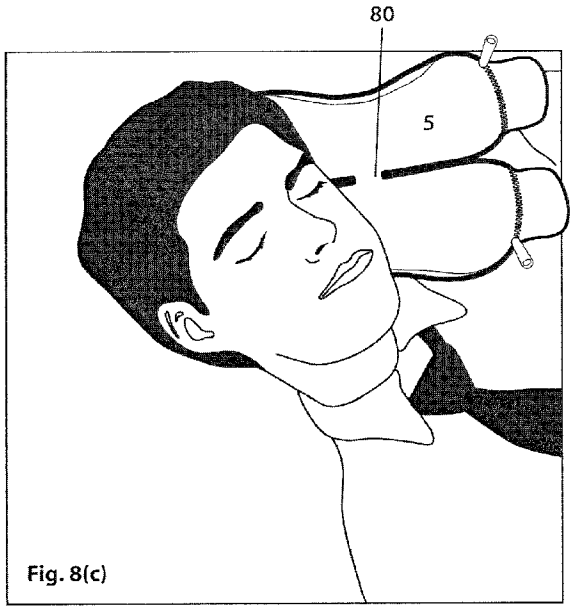
FIG. 8(*a*) shows another exemplary embodiment of the invention with a strap securing the legs of the support pillow together.
Figure 8D:
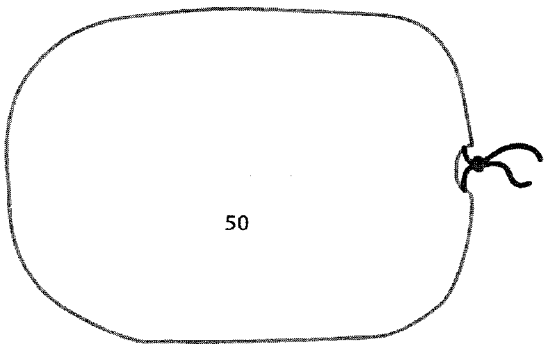
Figure 8B:
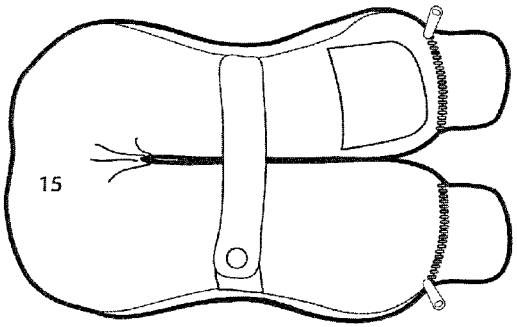
Figure 8A:
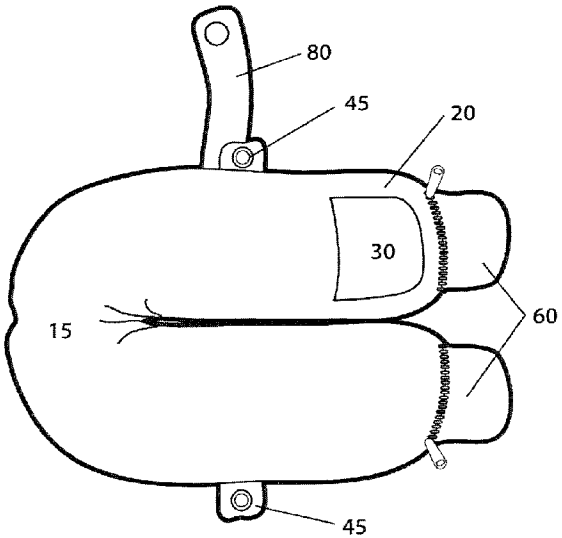

Turning to FIGS. 6(*a*), 6(*b*), and 7, the inside or interior 70 of the pillow body 10 is shown. The interior 70 is defined by an outer housing 72, which forms the outer surface of the pillow 5, as shown in FIGS. 1-5. The housing 72 is preferably made of a cloth or other soft material, such as a plush material. Or, the housing 72 can be a sturdy cloth or plastic material, and a plush outer covering can be provided that extends over the elastic retention 42 and pouches 60 and is removable for cleaning. The mask 40 can also be provided with a similar separate plush outer covering.

The interior 70 of the housing 72 of the pillow body 10 has an inflatable core 72 and a poly-filled middle portion 74 positioned between the central core 72 and the outer housing 72. The inflatable core 72 is made of a plastic closed bag that can be inflated (as shown in FIG. 6(*a*)) for use and deflated for storage. Deflating the core 72 makes the pillow body 10 smaller, thereby making it easier for storage and transportation. A tube and or valve stem (not shown) can be provided that extends from the core 72 through the housing 72 to be accessible by the user to inflate and deflate the core 72. Alternatively, the core 72 can be inflated by a pump mechanism contained within the interior 70, and deflated by a release valve that is within the interior 70 and operable from the outside of the pillow 5. Other suitable means can be used to inflate and deflate the central core 72. In addition, the core 72 can be partly inflated, to adjust the firmness and/or size (thickness) of the pillow body 10. And, it can also be deflated, if desired, when placed in the storage bag 50.

As shown in FIG. 7(*c*), the pillow can be deflated so that it lays flat (on the left in the embodiment shown. Turning momentarily to FIG. 7(*d*), the deflated pillow 5 can also be folded by pushing the legs 20 together and then folding the legs 20 over one another, as shown on the right in the embodiment of FIG. 7(*c*). The folded pillows can then be conveniently stored or placed in a suitcase for travel.

The middle portion 74 is located between the central inflatable core 76 and the outer housing 70. The middle portion 74 is filled with a filling material 75. The filling material 75 provides a comfortable medium for the user to sleep or rest, while also providing sufficient support to the user's neck and/or head. Baffles can be provided inside the pillow to define separate chambers of filling, to prevent the core 76 from sliding within the interior 70. It should be noted that although the inflatable core 72 is shown at the center of the pillow body 10, it can be located at one side of the pillow 5. And, though the core 72 and middle portion 74 are shown within an interior 70, the inflatable bag 72 can be at the rear and the fillable material can be contained in a bag secured to the top of the inflatable bag 72.

Turning to FIG. 7(*a*), the one or more pouches 60 (also shown in FIG. 3(*a*)) enable the thickness or firmness of the pillow 5 to be adjusted depending on the user's preferences. One or more of the zippers 28 are opened, and the pouches 60 are pulled out by the user. The pouches 60 are sewn to the body 10 so that they do not come free. When the pouches 60 are pulled out, they are in flow communication with the interior 70 and as a result they fill (partly or fully) with the filling material 75. This removes filling material 75 from the main body 10, reducing the firmness of the pillow 5. If both pouches 60 are used and sufficient filling material 75 allowed to enter into the pouches 60, the top of the pillow body 10 can be substantially compressed to form a trench 13 (best shown in FIG. 7(*b*)) that more comfortably receives the user's head; particularly when the seat has an angled top such as an airplane seat or bus seat. The user can push the fillable material 75 back into the interior 70 by forcing the pouch 60 back into the interior 70 of the body 10. It is noted that the storage bag can optionally be configured so that it does not fill with the fillable material 75.

Referring to FIGS. 8(*a*)-8(*c*), the support pillow 5 may include a strap 80 that holds the legs 20 of the support pillow 5 together, as shown. This allows the user to place his head against the pillow, as illustrated in FIG. 8(*c*). Starting with FIG. 8(*a*), the legs 20 are pushed together to form a rectangular shape. However, in order for the legs 20 to be pushed together, air must be removed from the core 76 and/or a portion of the filling material 75 must be displaced into one or more of the pouches 60. Once the legs 20 are together (FIG. 8(*a*)), the strap 80 can be removably coupled with the fastener 4 located on the opposite leg 20 at the opposite side of the body 10 (FIG. 8(*b*)). The strap 80 preferably extends across the rear 24 of the pillow body 10 (or one end of the strap could be permanently attached inside of the pillow and be stored away until use), and the user places his head on the front 22 of the pillow body 10 (FIG. 8(*c*)). In this embodiment, the pillow 5 has the form of a more traditional sleeping pillow with a single resting surface and a substantially rectangular shape, and can be rested against a surface, such as a window or wall. The storage bag 50 can also be pulled out and can be used as a pillow case, as shown in FIG. 8(*d*), and thus the storage bag 50 can be a fabric or plush material. The storage bag 50 can also be a compressible nylon or plastic that is more compact when stored.

Figure 9:
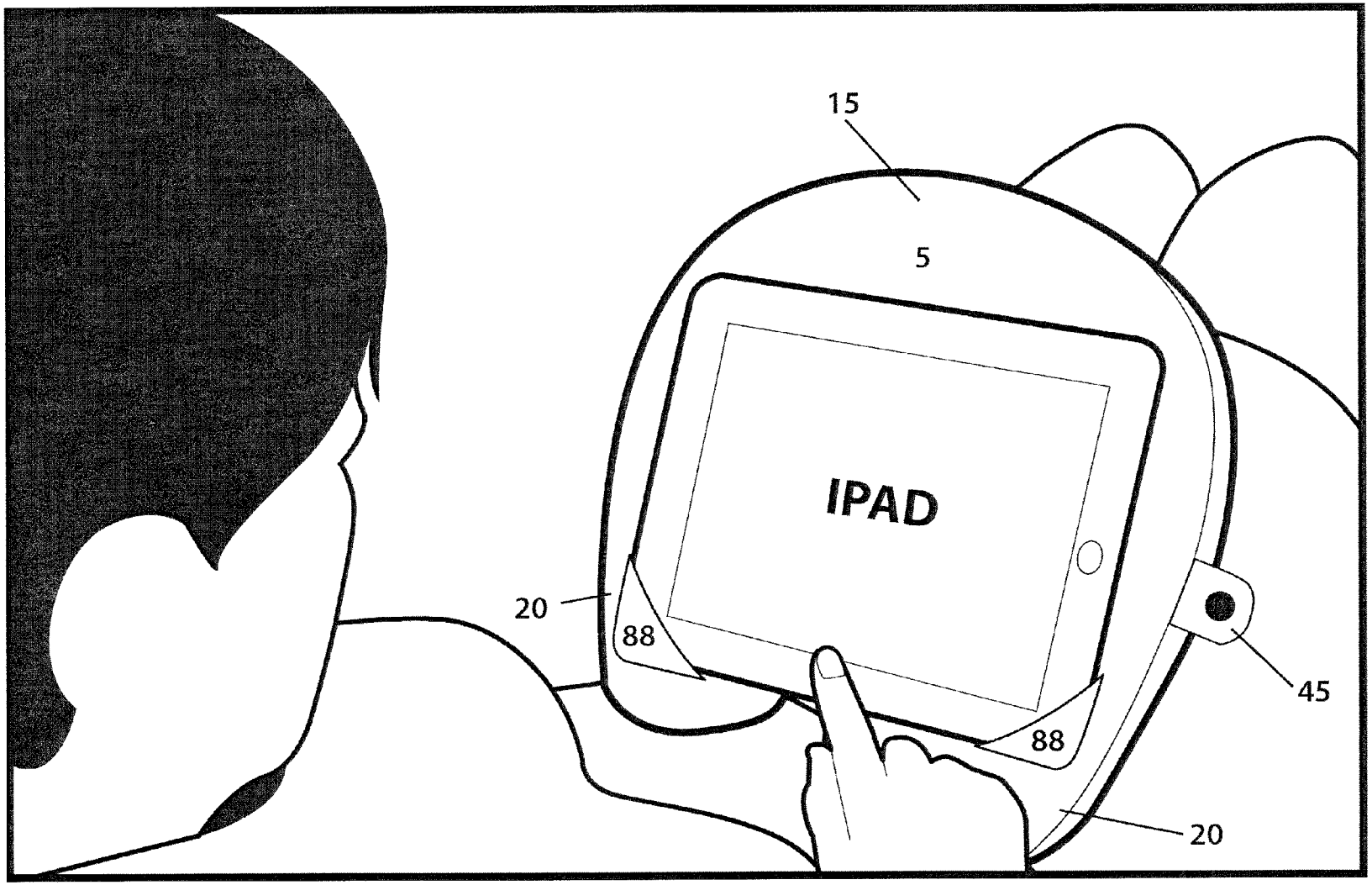
FIG. 9 shows another exemplary embodiment of the invention for use with a mobile computing device.

Turning to FIG. 9, the front of the support pillow 5 may include retention pockets 88 that are sized and shaped to hold a mobile computing device (preferably an IPAD™) or a book (electronic or hard copy) in place at the front 22 of the pillow 5 for viewing by the user. The retention pockets 88 are triangular in shape and secured along two sides, to form an opening that receives the book or mobile device. The retention pockets 88 preferably engage the two bottom corners of a rectangular mobile device, as shown, though other suitable configurations can be provided within the scope of the invention. The book then lie across the front 22 of the pillow 5, which can rest on the user's lap, as shown.

In accordance with an illustrative embodiment, the pillow can be 12 inches in width, 12 inches in length and 4 inches deep, and the sleep mask about 10½ inches long and 4 inches in height. The pillow is preferably made of plush fabric and spandex (nylon) and the sleep mask is plush fabric. The back side (FIG. 2) can be spandex except for the distal ends (represented by curved lines in the embodiment of FIG. 2) which are plush fabric, for instance, to make the IPAD® holders more secure. Though plush fabric can be flexible and have some give, it does not stretch and is more durable to accept thread.

Figure 10A:
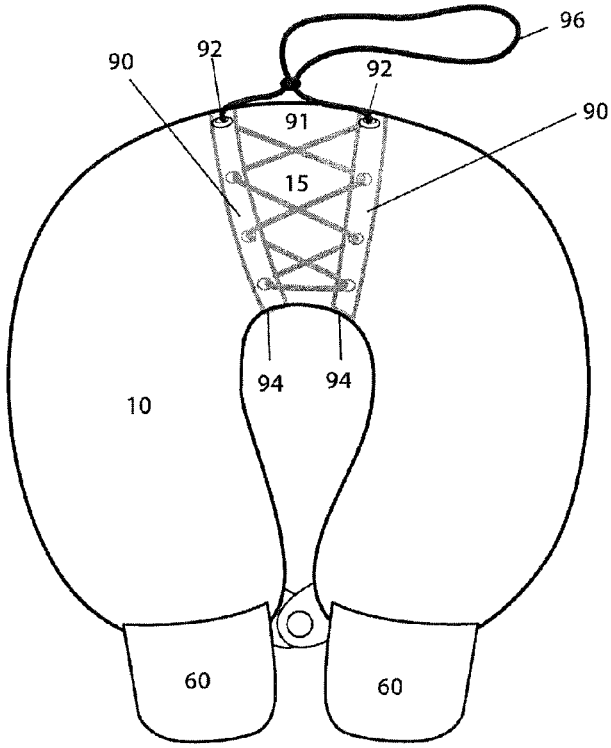
FIGS. 10 and 11 are plan views of a pillow that can be adjusted to fit the size of the user's neck.
Figure 10B:
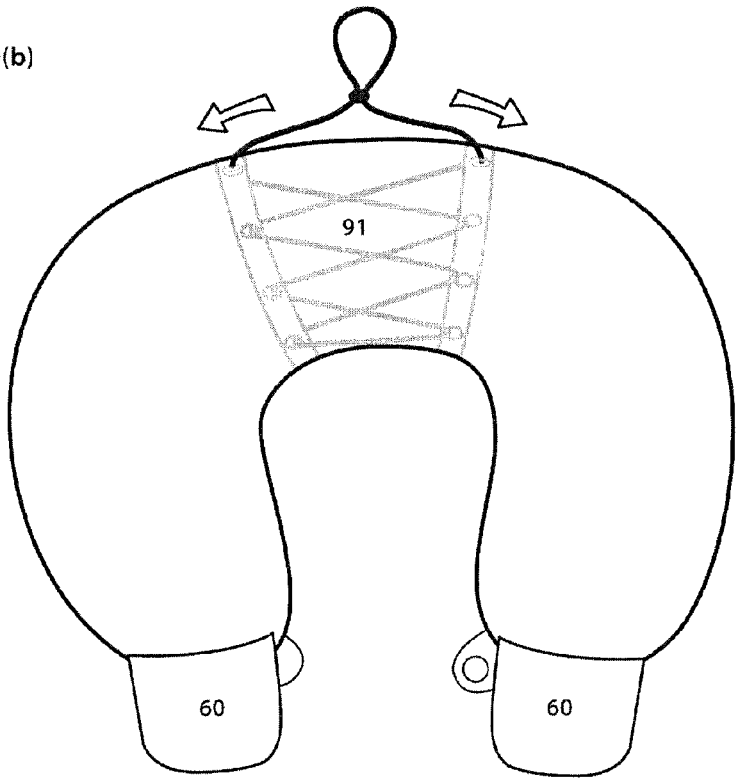
Figure 11A:
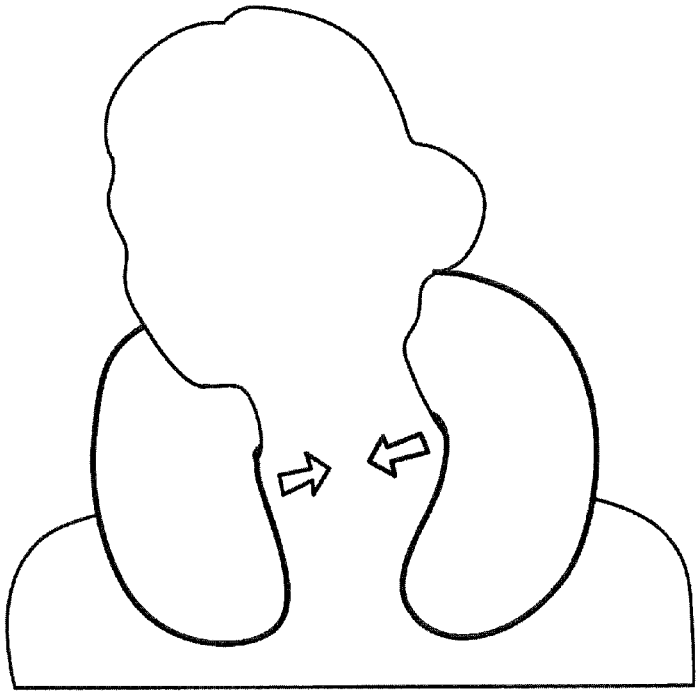
Figure 11B:
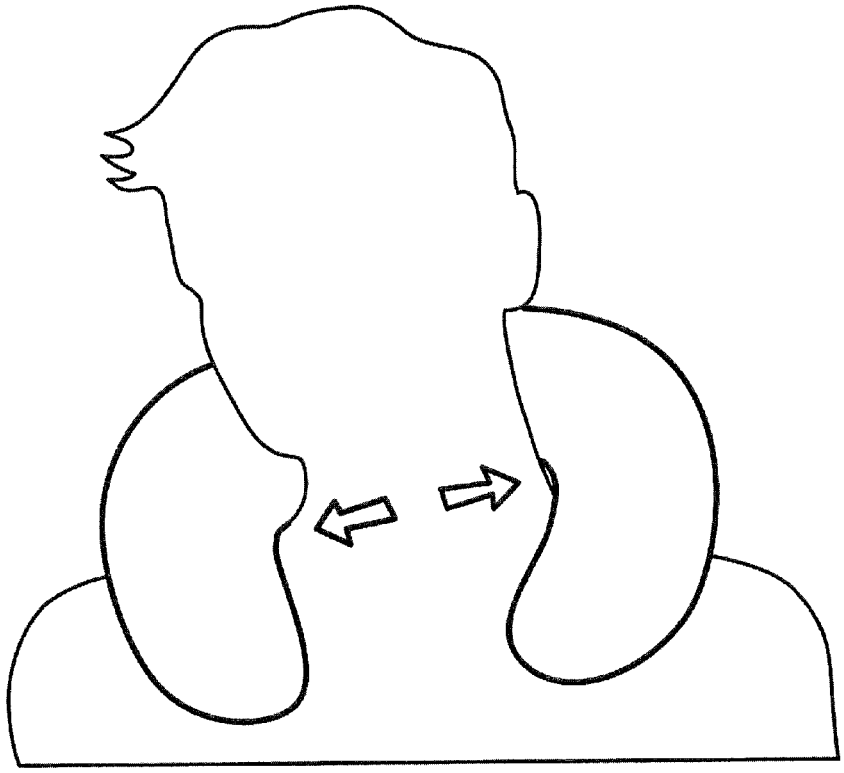

Referring now to FIGS. 10-11, an adjustability feature of the pillow is shown that allows the pillow to be widened or narrowed in the neck area to fit the user's neck size. In one non-limiting illustration of the adjustability, the pillow body 10 is provided with two elongated fastening strips 90 that extend transverse across the front and/or rear of the pillow. Each strip 90 has a first side 92 that is attached to the pillow body 10, and a second opposite side 94 that is unattached to the pillow body 10. As shown, the strip 90 is attached along the outer side of the strip 90 that is facing away from the other strip 90. The two strips 90 are preferably provided at the medial region 15 of the pillow body 10 to directly adjust for the neck size of the user. The strips 90 are separated from one another along the longitudinal direction of the pillow body 10 by a distance to define an adjustment zone 91. Each strip 90 has a set of openings or eyelets 92 that extend along the length of the strip 90.

A string 96 is provided that is laced through the eyelets 92 by passing under the unattached side 94 of the strip 90 and through the eyelets 92. The string 96 can be tightened (FIGS. 10(*a*), 11(*a*)) to constrict the pillow body 10 at the adjustment zone 91 by pulling the fastening strips 90 inward toward each other. In the constricted state, the pillow body 10 folds in on itself (e.g., if the pillow body 10 is non-elastic) or otherwise constricts (e.g., if the pillow body 10 is elastic) to fit users having a smaller neck. The string 96 can also be loosened (FIGS. 10(*b*), 11(*b*)) so that the adjustment zone 91 expands by allowing the fastening strips 90 to move outward away from each other so that the pillow body 10 expands, to fit users having a larger neck. It is noted that the user may need or want to use the pouches 60 to make it easier to constrict the adjustment zone 91.

It should be noted, however, that the adjustability of the pillow 5 need not be accomplished in the manner shown. And, while a strip 90 is provided, a strip 90 need not be utilized and instead a fastener mechanism can be directly connected to the pillow. Hence, any suitable configuration can be provided, such as buttons/holes, or zipper.

In addition, it is noted that the pillow 5 has a number of features, including for instance a sleep mask 40, fillable pouches 60, conversion between a neck pillow and a traditional pillow (FIG. 8), computing device retention pockets 88, inflatable interior core 76, storage bag 50, and adjustability 90. Though each of these features are shown and described for use together, they can be provided separately. Thus, any one or more of those features can be provided on a single pillow, and the pillow need not have all of those features together.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. A pillow comprising:

a pillow body having a medial region and a pair of legs that extend from the medial region to define an opening there between, said pillow body having an interior with a maximum volume and said pair of legs each have a distal end;

filling material contained within the interior of said pillow body; and a pouch coupled with and configured to extend outward from at least one of the distal ends of said pillow body and in flow communication with the interior to removably receive up to a maximum volume of the filling material from the interior when the pillow is in use;

wherein the maximum volume of the pouch is less than the maximum volume of the pillow body.

2. The pillow of claim 1, wherein the pillow further comprises a strap that releasably secures the legs of the support pillow together.

3. The pillow of claim 1, wherein said pouch can be positioned within the interior of said pillow body.

4. The pillow of claim 3, further comprising a fastener for securing the pouch within the interior of said pillow body.

5. The pillow of claim 1, wherein the legs can be more easily pushed together when the fillable material enters said pouch.

6. The pillow of claim 1, further comprising an inflatable member located inside the interior of said pillow body.

7. The pillow of claim 1, wherein the pillow maintains its overall shape.

8. The pillow of claim 1, wherein a firmness of the pillow is adjustable by moving the filling material between the interior of the pillow body and the pouch.

9. The pillow of claim 1, wherein a substantial portion of the filling material remains within the interior of said legs when the pouch receives the maximum volume of the filling material.

10. A pillow comprising:

a pillow body having a medial region and a pair of legs each having a distal end, said pair of legs extending from the medial region to define an opening therebetween, said pillow body defining a front, a rear, a top, a bottom, a first side and a second side opposite the first side, said pillow body further having an interior with a maximum volume;

an inflatable member located at the interior of said pillow body;

filling material located at the interior of said pillow body and positioned about said inflatable member; and a pouch coupled with and configured to extend outward from at least one of the distal ends of said pillow body and in flow communication with the interior to removably receive up to a maximum volume of the filling material from the interior when the pillow is in use, wherein the pillow is configured such that, the maximum volume of the pouch is less than the maximum volume of the pillow body interior.

11. The pillow of claim 10, wherein the pillow maintains its overall shape.

12. The pillow of claim 10, wherein a firmness of the pillow is adjustable by moving the filling material between the interior of the pillow body and the pouch.

13. The pillow of claim 10, wherein a substantial portion of the filling material remains within the interior of said legs when the pouch receives the maximum volume of the filling material.

* * * * *